US011688536B2

(12) United States Patent
Cobos Reyes et al.

(10) Patent No.: US 11,688,536 B2
(45) Date of Patent: Jun. 27, 2023

(54) INDUCTOR DEVICE, METHOD OF MANUFACTURING SAME AND ANTENNA

(71) Applicant: PREMO, S.A., Campanillas (ES)

(72) Inventors: Sergio Cobos Reyes, Malaga (ES); Antonio Rojas Cuevas, Malaga (ES); Claudio Cañete Cabeza, Benalmadena (ES); Francisco Ezequiel Navarro Perez, Barcelona (ES)

( * ) Notice: Subject to any disclaimer, the term of this patent is extended or adjusted under 35 U.S.C. 154(b) by 992 days.

(21) Appl. No.: 16/484,753

(22) PCT Filed: Feb. 6, 2018

(86) PCT No.: PCT/EP2018/052910
§ 371 (c)(1),
(2) Date: Aug. 8, 2019

(87) PCT Pub. No.: WO2018/146078
PCT Pub. Date: Aug. 16, 2018

(65) Prior Publication Data

US 2020/0051721 A1 Feb. 13, 2020

(30) Foreign Application Priority Data

Feb. 9, 2017 (EP) ..... 17380004

(51) Int. Cl.
*H01F 5/02* (2006.01)
*H01F 41/071* (2016.01)
*H01F 27/26* (2006.01)

(52) U.S. Cl.
CPC ..... *H01F 5/02* (2013.01); *H01F 27/266* (2013.01); *H01F 41/071* (2016.01); *H01F 2005/027* (2013.01)

(58) Field of Classification Search
CPC ..... H01F 5/02; H01F 27/266; H01F 41/071; H01F 2005/027; H01F 2005/046
See application file for complete search history.

(56) References Cited

U.S. PATENT DOCUMENTS 4,210,859 A 7/1980 Meretsky et al.
4,287,809 A 9/1981 Egli et al.
(Continued)

FOREIGN PATENT DOCUMENTS

EP 0333113 A2 9/1989
EP 1315178 A1 * 5/2003 ..... H01F 27/325
(Continued)

*Primary Examiner* — Tuyen T Nguyen
(74) *Attorney, Agent, or Firm* — Eugenio J. Torres-Oyola; Rafael Rodriguez-Muriel; Victor M. Rodriguez-Reyes

(57) ABSTRACT

The present invention relates to an inductor device, a method of manufacturing same and antenna. The proposed inductor device comprising a magnetic core (1), an electrically insulating support (10) with a cavity (11) arranged around said magnetic core (1), and three windings (DX, DY, DZ) of conductive wire arranged orthogonal to one another, wherein said electrically insulating support (10) is made of a single part and completely houses the magnetic core (1) which is accessible through an opening, the three windings (DX, DY, DZ) being supported on winding supporting faces (12X, 12Y and 12Z) of the electrically insulating support, confined between winding limiting edges (22) defined by lower corner protuberances (20) and centered with respect to the three orthogonal axes (X, Y, Z) such that said electrically insulating support (10) assures symmetry and orthogonality of said electromagnetic field vectors generated by the mentioned inductor device.

16 Claims, 6 Drawing Sheets

(56) References Cited

U.S. PATENT DOCUMENTS

| | | | | |
|---|---|---|---|---|
| 6,696,638 | B2 | 2/2004 | Esguerra et al. | |
| 7,755,558 | B2 * | 7/2010 | Ueda | H01Q 21/24 343/788 |
| 10,806,521 | B2 * | 10/2020 | Wald | A61B 90/39 |
| 11,495,394 | B2 * | 11/2022 | Canete Cabeza | H01F 27/263 |
| 2005/0189882 | A1 * | 9/2005 | Baarman | H05B 39/00 315/62 |
| 2019/0164680 | A1 * | 5/2019 | Cobos Reyes | H01F 27/266 |

FOREIGN PATENT DOCUMENTS

| | | | |
|---|---|---|---|
| EP | 1315178 | B1 | 2/2004 |
| EP | 1634308 | B1 | 2/2007 |
| EP | 2560234 | A1 | 2/2013 |
| EP | 2879237 | A1 | 6/2015 |
| EP | 2911244 | A1 | 8/2015 |
| WO | 2005/062316 | A2 | 7/2005 |
| WO | 2016/038434 | A1 | 3/2016 |

* cited by examiner

INDUCTOR DEVICE, METHOD OF MANUFACTURING SAME AND ANTENNA

FIELD OF THE ART

The present invention relates to an inductor device and to the method of manufacturing same, said inductor device including a magnetic core, an electrically insulating support arranged around said magnetic core and three windings of conductive wire, arranged orthogonal to one another, wound around said magnetic core, the conductive wire of the windings being supported on said electrically insulating support.

The invention also relates to an antenna, particularly a low-frequency transmitting or receiving antenna built using the mentioned inductor device, used primarily for detecting and/or transmitting the position and movement of objects that require precise control, such as those used, for example, in virtual reality systems in which an electromagnetic system must have the capacity to locate in the virtual (or digital) world, the actual object of the physical world, in an exact relative location and with the actual movements, speeds and accelerations in the three spatial coordinate components thereof.

The objective of this invention is achieved based on the principle that the response in terms of voltage induced by the magnetic field induction unit of a low-frequency inductor is directly proportional to the relative position thereof with respect to the field source.

The inductor device of the present invention forming a three-axis magnetic inductor or sensor allows generating a standard electromagnetic field that is isotropic, has constant frequency and intensity as well as identical characteristics in the three orthogonal coils wound around one and the same core but supported on the surfaces of an electrically insulating support. It is thereby possible to induce in said inductor or component wound on three orthogonal axes a voltage having a modulus proportional to the relative distance with respect to the source (position indication) and three coordinates x, y, z the relationship of which determines the angle of rotation with respect to the source position vector. The proposed inductor thereby generates a vector reference system orthogonal in three dimensions ($R^3$) corresponding to the vector induction components of its three orthogonal windings. Any other receiving inductor introduced in the reference system will receive in each axis a voltage proportional to its vector distance, the angle of rotation of the receptor with respect to the reference system being determined by the ratio between the voltage of each axis and the entire module.

STATE OF THE ART

Patent document U.S. Pat. No. 4,287,809 (Honeywell) discloses an electromagnetic system for determining the orientation, including the position of a helmet, including a transmitting antenna for transmitting electromagnetic field vectors, a receiving antenna for sensing said electromagnetic field vectors and a control apparatus for determining the orientation, including the location of the helmet, depending on said transmitted and sensed electromagnetic field vectors. FIG. 3 of the drawings of this patent document describes a possible embodiment of the transmitting and receiving antennas used, in which they can be seen to comprise a ferrite core around which three windings are wound orthogonal to one another.

Patent document U.S. Pat. No. 4,210,859 (Technion Research) likewise describes a structure for a three-dimensional antenna with three orthogonal windings, respectively, likewise suitable for providing an inductor such as the one referred to in this invention. FIG. 17 of the drawings shows a particular embodiment of the magnetic core of the inductor in the shape of a cube with protuberances at its vertexes defining winding up channels for arranging the mentioned orthogonal windings.

On the other hand, patent document EP 1315178 (ABB) describes an electromagnetic inductor configuration comprising a cubic core and three orthogonal windings supported on the faces of two hollow half cubes formed from an insulating plastic material and provided at the vertexes thereof with protuberances, the magnetic core being arranged inside the cavities of said two half cubes arranged with the open faces thereof opposite one another.

Assuring exact orthogonality of the magnetic field vectors in any of said prior art documents requires positioning the spirals on the core, which is bare or insulated with a thin layer of adhesive polyester or Kapton tape-type insulator, with extreme care in a slow precision process, which makes industrial implementation difficult, and imperfections of the core on which winding up is performed or the differences or non-coplanarity of the two opposite halves in the case of the solution described in patent document EP 1315178 must furthermore be overcome.

Patent document EP 2911244 describes an antenna and an antenna manufacturing method, the antenna comprising a magnetic core and three windings wound around it, using an electrically insulating base divided into two parts providing a support portion around the perimeter of which an external winding is supported.

The use of magnetic core-associated electrically insulating supports has been described so far in various documents basically for:

- assuring the insulation and safety distances of the windings, as well as fixing and shaping the winding up assembly;
- duly containing and guiding the windings and making the connection thereof to a PCB or circuit easier;
- configuring winding up topologies (multi-section, for example, to reduce distributed capacitances or reduce the voltage supported between the ends of the windings); and
- allowing the incorporation of additional elements such as fuses, sensors, etc., and generally making winding up process automation easier.

Patent document U.S. Pat. No. 6,696,638 describes a magnetic core obtained from a plurality of electromagnetic grains agglomerated in a matrix by way of cement.

Patent document WO2016038434 describes a magnetic core, particularly for an antenna, obtained by means of PBSM (Polymer Bonded Soft Magnetic material) injection obtained by means of incorporating ferromagnetic nanoparticles in a polymeric matrix by means of and particularly including microfibers, microparticles or nanoparticles of a soft ferromagnetic material.

None of the mentioned prior art documents explains the use of an electrically insulating support to prevent magnetic core imperfections and asymmetries from translating into deviations in the position of the windings which will have an impact on the isotropy of the induction vectors generated by each of the windings.

Document EP1634308 describe an antenna including a magnetic core inserted in an electrically insulating support surrounded by three orthogonal windings, said electrically insulating support including winding channels defined by winding support outer surfaces and winding limiting edges perpendicular to the winding supporting outer faces defined in eight corner protuberances of the electrically insulating support. But this document is silent about the obtention of an isotropic inductor device, because the magnetic core described in this document is not isotropic and the three orthogonal windings have different lengths and number of windings producing three different magnetic fields intended for RFID applications.

Furthermore, the electrically insulating support described on this document EP1634308 include eight corner protuberances surrounding the eight corners of the magnetic core, being said electrically insulating support of a complex shape unfeasible to be produced in a two-part mold, requiring the mold to be made at least of four different movable parts in order to produce such complex shape.

BRIEF DESCRIPTION OF THE INVENTION

According to a first aspect, the present invention relates to an inductor device suitable for building a transmitting or receiving antenna provided for interacting with an electromagnetic system.

Unlike the indicated solutions from the state of the art, the present invention provides an electrically insulating support, generally a cubic support, entirely housing the also cubic core, and winding up is directly performed on said electrically insulating support (obtained, for example, by means of high-precision injection molding), which allows fixing the spirals of the windings in an automatic high-speed winding up process on said electrically insulating support which has configurations demarcating physical limits and assuring uniform and repetitive winding symmetry, producing the best orthogonality between windings (DX, DY, DZ).

According to the proposal of this invention, the mentioned inductor device comprises:

- a rectangular prismatic magnetic core with six faces and eight vertexes defining three axes X, Y, Z orthogonal to one another;
- an electrically insulating support made of a single part with a rectangular prismatic cavity arranged around said magnetic core, said cavity completely housing the magnetic core and being accessible through an opening surrounded by a frame having four sides arranged opposite one another in pairs, said frame being arranged flush with or above the level of the magnetic core, said electrically insulating support being provided with:
  - winding supporting outer faces each perpendicular to one of said axis,
  - four additional winding supporting outer faces formed on said four sides of the opening and having winding limiting edges associated therewith,
  - four lower corner protuberances arranged on four vertexes of the magnetic core, including winding limiting edges perpendicular to the winding supporting outer faces confining windings of conductive wire wound up around axes X and Y between said respective winding limiting edges and supported on said winding supporting faces, and wherein three windings of conductive wire are arranged orthogonal to one another wound around said magnetic core, being supported on the winding supporting faces, confined between the winding limiting edges and centered with respect to the orthogonal axes X, Y, Z, such that when a current circulates through the mentioned windings an electromagnetic field with electromagnetic field vectors coaxial with the axes of each of the windings is generated It will be understood that said six faces of the magnetic core are three pairs of opposite faces facing and parallel to one another, each of them being a rectangular or square, and that said three axes X, Y, Z are each perpendicular to one of said pairs of faces.

It will be understood that each of said winding supporting outer faces will be parallel to one of the six faces of the magnetic core, such that the winding supported on said winding supporting outer faces will be parallel to the magnetic core.

Furthermore, the winding limiting edges provided by the four lower corner protuberances demarcate said winding supporting outer faces, confining the respective windings in directions orthogonal to one another. Preferably, each lower corner protuberance has six winding limiting edges, two of them for limiting each of the three windings mentioned above.

The mentioned electrically insulating support is proposed to be a single hollow part open on one of the faces thereof for completely housing the core, such that said electrically insulating support surrounds all but one of the six faces of the magnetic core and is lacking of upper corner protuberances on the remaining four vertexes of the magnetic core, so that the electrically insulating support can be produced in a two part mold.

In other words, the magnetic core is completely inserted into said cavity of the electrically insulating support through a single open face of said support providing access to the cavity, such that the mentioned magnetic core does not protrude from said support, and said electrically insulating material can be produced with a high precision molding procedure using a mold made up of only two movable parts thanks to its shape, which can be easily unmolded in an axial direction, non-having overlapped protrusions in the Z axis direction coincident with the un-molding direction.

This allows the support to completely surround the magnetic core, except for one of the faces thereof, being a support obtained as a single part (for example, by means of a high-precision plastic material molding operation), which makes the tasks of centering the magnetic core and performing orthogonal winding up around said magnetic core easier, said orthogonality being essential for precision of the inductor device produced. As is known by the Biot-Savart law in physics, the magnetic induction vector direction generated by a current in a conductive spiral is orthogonal to the surface vector forming said spiral. In other words, the generated field is orthogonal to the winding up on each infinitesimal section surface thereof and not to the cross-section of the core as is generally assumed in the industry. The present invention seeks to improve the behavior and symmetry of the device by means of making the winding independent of the morphology of the core since the winding cross-section will be assured by the configuration of the reel regardless of the symmetry imperfections of the core inside it.

Following features shall be considered important features of the invention not known from the state of the art:

- said electrically insulating support surrounds all but one of the six faces of the magnetic core and is lacking of upper corner protuberances in correspondence with the remaining four vertexes of the magnetic core, so that the electrically insulating support is producible in a two part mold, and said winding up channels are centered with respect to the three orthogonal axes X, Y, Z;

said frame is arranged flush with or above the level of the magnetic core, and said winding supporting outer faces, where the third winding is wound, provide surfaces delimited on one side by said limiting edges of the lower corner protuberances; and said third winding is centered with respect to the orthogonal axes X and Y;

wherein said two winding up channels and said third winding are configured to in combination with the dimensions of the magnetic core define three isotropic orthogonal magnetic fields.

According to an alternative embodiment, the winding around the axis Z is formed by an electrically conductive wire provided with a self-adhesive coating if the four lower corner protuberances confine the windings wound around axes X and Y between their respective winding limiting edges. In this case, the winding limiting edges of the mentioned four lower corner protuberances will only confine the winding wound around the axis Z on the side thereof closest to the lower end of the inductor device, but not on the farthest end. The self-adhesive conductive wire will keep said conductive wire in place even without the existence of four additional upper corner protuberances confining it, although in this case a stop or counterpoint will be placed against the mentioned open face of the electrically insulating support and is removable after the high-speed winding up operation for demarcating the upper winding.

According to an alternative embodiment not claimed in this document but a feasible alternative embodiment of the invention, said electrically insulating support further comprises four upper corner protuberances arranged on the remaining four vertexes of the magnetic core, including winding limiting edges perpendicular to the winding supporting faces.

According to another embodiment, said magnetic core is proposed to be formed by a block tightly inserted into said hollow part forming the electrically insulating support.

Alternatively, said magnetic core is proposed to be formed by a magnetic cement (according to the teachings of aforementioned patent document U.S. Pat. No. 6,696,638) set inside said electrically insulating support, i.e., a magnetic cement in liquid form poured into the cavity of the electrically insulating support and hardened therein, said inner cavity of the electrically insulating support acting as a mold. Therefore, as the core is subsequently formed, it is assured that the shape thereof corresponds precisely with the shape of the reel assuring symmetry and isotropy by means of the faces and outer configuration thereof.

The mentioned magnetic core is proposed to be coated with a polymer or epoxy resin layer occupying said open face of the electrically insulating support when it is required to preserve the absorption of moisture outside the core, although it generally will not be applicable. In other words, it is proposed to seal the only face of the magnetic core not covered by the electrically insulating support by means of an epoxy resin layer which also has electrical insulating properties and completes the covering of the magnetic core.

Preferably, the height of the magnetic core will be less than the depth of the inner cavity of the electrically insulating support, and the difference will be filled with said epoxy resin layer. The winding up after resin application and hardening will cover said epoxy resin.

Preferably, the magnetic core and the mentioned electrically insulating support housing it are cubic, providing an inductor with isotropic properties which requires that the actual and imaginary permeabilities and susceptibilities of the core are identical in the three spatial axes. The preferred use of PBM (Polymer Bonded Magnetics) or magnetic cements allows avoiding core forming processes which establish a preferential direction of magnetization conferring anisotropy (core lamination, extrusion and pressing incorporate relevant degrees of anisotropy that are prevented in this invention). Since the magnetic core has the same height, width and depth dimensions, the induced magnetic field is uniform in the three axes X, Y, Z if the material is isotropic in terms of magnetic permeability and susceptibility as well as electrical resistivity. To that end, it is also important for the three windings to be perfectly orthogonal to one another and contain the same number of turns of the electrically conductive wire cooperating with the winding supporting faces of the mentioned electrically insulating support made as a single part as indicated.

Since the inductor device is an isotropic device, it can be used as a precise detector for precisely detecting the relative position thereof on the three axes with respect to an electromagnetic wave emitting source, or as an emitter of electromagnetic waves that are uniform in all directions.

According to another embodiment, each winding of conductive wire has an entry point for a conductive wire and an exit point for said conductive wire that are different from one another and connected to the ends of electrically conductive elements integrated in each of said lower corner protuberances. The electrically conductive elements therefore act as connectors which allow integrating the inductor device into electrical or electronic systems, electrically contacting each of said conductive wires of the winding through said electrically conductive elements.

Furthermore, the mentioned electrically insulating support is proposed to include guiding configurations for guiding the conductive wire of each of the windings between the entry point and the corresponding electrically conductive element thereof and between the exit point and the corresponding electrically conductive element thereof, said guiding configurations being formed by a notch, stepped recess or groove, such that a tensioned conductive wire is precisely positioned in relation to the winding supporting outer face and the winding up direction at said entry point.

Finally, the winding supporting outer faces are proposed to comprise winding supporting outer faces X, winding supporting outer faces Y, and winding supporting outer faces Z, and the faces corresponding to two different bisecting windings are proposed to be arranged at a different level and linked in the stepped intersections forming winding limiting edges.

The electrically insulating support has five main outer faces and an open sixth main outer face, and two windings will bisect one another in an orthogonal manner on each of said faces. Each of said six main outer faces of the electrically insulating support will therefore have winding supporting faces arranged at two different levels connected by a step, defining two winding up channels arranged at different levels and bisecting one another, a deeper winding up channel being defined by a continuous winding supporting face along the entire length of the corresponding main outer face, and a winding up channel superimposed on the preceding channel defined by two winding supporting faces arranged on opposite sides of the aforementioned continuous winding supporting face and protruding from same.

The opening providing access to the inner cavity of the electrically insulating support will be surrounded by a frame having four sides arranged opposite one another in pairs, two of said sides being at a lower level with respect to the other two sides, said four sides forming four winding supporting outer faces. This embodiment allows winding up in two orthogonal directions, covering this face of the electrically insulating support where the opening of the inner cavity is arranged to also be performed at two different levels.

In this case, the depth of the cavity will be defined from the side closest to the bottom of said cavity.

According to a second aspect, the present invention relates to a method of manufacturing an inductor device. The mentioned method comprises the following steps:

- producing a high thermal and mechanical stability thermosetting plastic-based polymeric electrically insulating support by high-pressure injection molding, being made of a single hollow part with a rectangular prismatic cavity open on one of the faces thereof, provided for completely housing a magnetic core, and being accessible through an opening surrounded by a frame having four sides arranged opposite one another in pairs, said support being provided with:
  - two orthogonal winding up channels dimensioned to delimit respective two orthogonal windings, said winding up channels being defined by winding supporting outer faces each perpendicular to one axis X, Y or Z, winding limiting edges (22) perpendicular to the winding supporting outer faces (12X, 12Y), four additional winding supporting outer faces (12X and 12Y) formed on said four sides (51) of the frame (50) and the winding limiting edges (22) associated therewith;
  - winding supporting outer faces (12Z) perpendicular to one of said axis X and Y and configured to support a third winding (DZ) orthogonal to the other two windings (DX, DY);
  - four lower corner protuberances including winding limiting edges perpendicular to the winding supporting outer faces,
  - providing, inside said rectangular prismatic cavity of the electrically insulating support, a rectangular prismatic magnetic core with eight vertexes and three pairs of opposite faces facing and parallel to one another, defining said three axes X, Y and Z orthogonal to one another each perpendicular to one of said pairs of faces and passing through the geometric center of the faces;
  - providing three windings of conductive wire arranged orthogonal to one another wound around said magnetic core, and supported on the winding supporting faces, confined between the winding limiting edges.

The present method also proposes following important steps:

- produce the electrically insulating support through a two-part mold lacking of upper corner protuberances in correspondence with the remaining four vertexes of the magnetic core, with said frame being arranged flush with or above the level of the magnetic core, and with the two orthogonal winding up channels being centered with respect to the orthogonal axes X, Y and Z, wound the third winding on said winding supporting outer faces delimited on one side by said limiting edges of the lower corner protuberances, centered with respect to the orthogonal axes X and Y, configured so that in combination with the dimensions of the magnetic core and with the other two orthogonal windings define three isotropic orthogonal magnetic fields.

The electrically insulating support produced is provided for completely housing the magnetic core inside its cavity; this means that the magnetic core housed inside said cavity does not protrude from the electrically insulating support, and is completely surrounded by five of its six faces.

According to a proposed embodiment, said magnetic core is formed by a block which is tightly inserted into said hollow part, forming the electrically insulating support.

Alternatively, said magnetic core is proposed to be formed by a magnetic cement which is poured into and sets inside the inner cavity of said hollow part forming said electrically insulating support. In other words, the inner cavity of the electrically insulating support acts as a recipient for containing a magnetic cement in liquid or viscous state poured into it and as a mold during the curing of said magnetic cement during setting and hardening, providing a solid magnetic core with a shape complementary to the shape of the inner cavity of the electrically insulating support when said setting ends.

According to another embodiment, the mentioned magnetic core is proposed to be coated with an epoxy resin layer occupying said open face of the electrically insulating support, both when the magnetic core is an inserted block and a hardened magnetic cement. Five faces of the magnetic core will therefore be covered by the electrically insulating support and the sixth face will be coated and sealed by means of said epoxy resin layer, completely and uniformly insulating the magnetic core.

Additionally, the provided magnetic core is proposed to have a height less than the depth of the inner cavity of the electrically insulating support and the epoxy resin is proposed to be poured in liquid form and then hardened inside the inner cavity of the electrically insulating support after providing the magnetic core, said epoxy resin being contained in the inner cavity space not occupied by the magnetic core. The inner cavity space not occupied by the magnetic core therefore acts a mold for the epoxy resin.

According to another embodiment, the magnetic core is proposed to be produced by high-precision injection molding of PBM (Polymer Bonded Magnetics) obtained by means of incorporating ferromagnetic nanoparticles in a polymeric matrix with dispersants, said injected body being able to include microfibers, microparticles or nanoparticles of a soft ferromagnetic material, as describe in patent application WO2016038434.

According to another proposed embodiment not claimed in this document but a feasible alternative embodiment of the invention, said electrically insulating support is provided further including four upper corner protuberances arranged on the remaining four vertexes of the magnetic core, including winding limiting edges perpendicular to the winding supporting faces. Said upper corner protuberances allow, in collaboration with the lower corner protuberances, completely confining and guiding the three windings, assuring the perfect orthogonal positioning thereof.

Alternatively, it is proposed to provide additional upper corner protuberances with respect to the electrically insulating support before winding up, and for them to be removed when said winding up ends, such that the winding surface corresponding to the axis Z is demarcated during winding up between the electrically insulating support and said removable upper corner protuberances, and the final inductor device being without said upper corner protuberances.

According to an additional embodiment of the proposed method:

- the electrically insulating support is produced including electrically conductive elements (20) integrated in each of said lower corner protuberances; and wherein
- each winding of conductive wire has an entry point for a conductive wire and an exit point for said conductive wire that are different from one another and connected to the ends of said electrically conductive elements (20).

Said electrically conductive elements can be, for example, metal pins partially embedded in the lower corner protuberances, being partially exposed for connecting the proposed inductor device to an electrical or electronic system. Alternatively, said electrically conductive elements can be an electrically conductive covering deposited on the surface of said lower corner protuberances for the same purpose.

Additionally:

the electrically insulating support is proposed to be produced including guiding configurations for guiding the conductive wire of each of the windings between the corresponding entry point and the electrically conductive element thereof and between the corresponding exit point and the electrically conductive element thereof, said guiding configurations being formed by a notch, stepped recess or groove; and wherein the winding up process for winding up the three windings is performed in three successive steps, each of which includes:

automatically positioning a tensioned conductive wire in its corresponding guiding configuration, a portion of said conductive wire being precisely positioned in relation to the winding supporting outer face at said entry point and in the winding up direction;

automatically winding up said conductive wire around the magnetic core on the winding supporting outer faces from said entry point to the corresponding exit point, the winding being confined between the corresponding winding limiting edges;

automatically positioning a portion of said tensioned conductive wire from the exit point in its corresponding guiding configuration, being precisely positioned in relation to said exit point;

In other words, an automatic winding device will automatically position a tensioned conductive wire inside a guiding configuration of the electrically conductive support, said guiding support being one that assures precise positioning of a portion of the conductive wire on the entry point of the corresponding winding as a result of its notch-, recess-, step- or groove-shaped geometry, assuring that a tensioned conductive wire will be precisely positioned in the deepest portion thereof, guiding it to said entry point.

Once the precise positioning at said entry point is assured, the winding up device automatically winds up the winding, assuring precision in the positioning of each turn of the winding, until reaching the exit point.

The automatic winding up device then positions the tensioned conductive wire inside its corresponding guiding configuration which, as it does in relation to the entry point, allows precisely positioning the conductive wire as a result of its geometry, assuring that the exit point is precise.

Furthermore, said automatic winding up process is also proposed to include electrically connecting in an automatic manner each end of the conductive wire forming a winding to a corresponding electrically conductive element (20) of a lower corner protuberance, said tensioned conductive wire being arranged between the mentioned electrical connection, the guiding configuration, and the corresponding winding entry or exit point thereof.

A precise inductor device obtained in a quick and automatic manner is obtained by repeating this process three times for each of the three provided windings.

According to a third aspect of the invention, an antenna, particularly a low-frequency antenna built based on the explained inductor device is provided.

Other features of the invention will become apparent in the following detailed description of an embodiment.

BRIEF DESCRIPTION OF THE DRAWINGS

The foregoing and other advantages and features will be netter understood based on the following detailed description of an embodiment in reference to the attached drawings which must be interpreted in an illustrative and non-limiting manner, in which.

DETAILED DESCRIPTION OF AN EMBODIMENT

Figure 1:
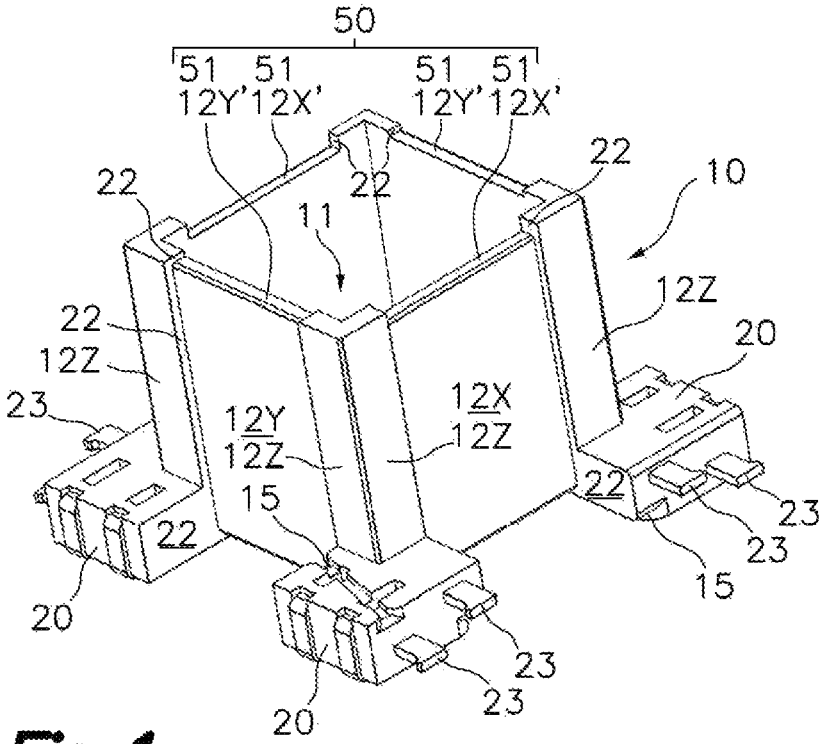
FIG. 1 shows a top perspective view of the electrically insulating support, without the magnetic core and windings, showing the inner cavity and the opening thereof, according to an embodiment provided with lower corner protuberances including electrically conductive elements and guiding configurations, and without upper corner protuberances.

The attached drawings show illustrative, non-limiting embodiments of the present invention.

According to a first embodiment of the present invention, the inductor device consists of a cubic magnetic core 1 having six squares faces, defining an axis X, an axis Y, and an axis Z, said core being tightly inserted into an also cubic inner cavity 11 of an electrically insulating support 10, completely covering five of the six faces of the magnetic core 1 and leaving the sixth face of the magnetic core exposed through an opening for accessing the mentioned inner cavity 11.

Said electrically insulating support 10 has winding supporting outer faces 12X, 12Y and 12Z, parallel to the faces of the magnetic core, and four lower corner protuberances 20 arranged on four vertexes of the magnetic core 1, including winding limiting edges 22 perpendicular to the winding supporting outer faces 12X, 12Y and 12Z.

Figure 3:
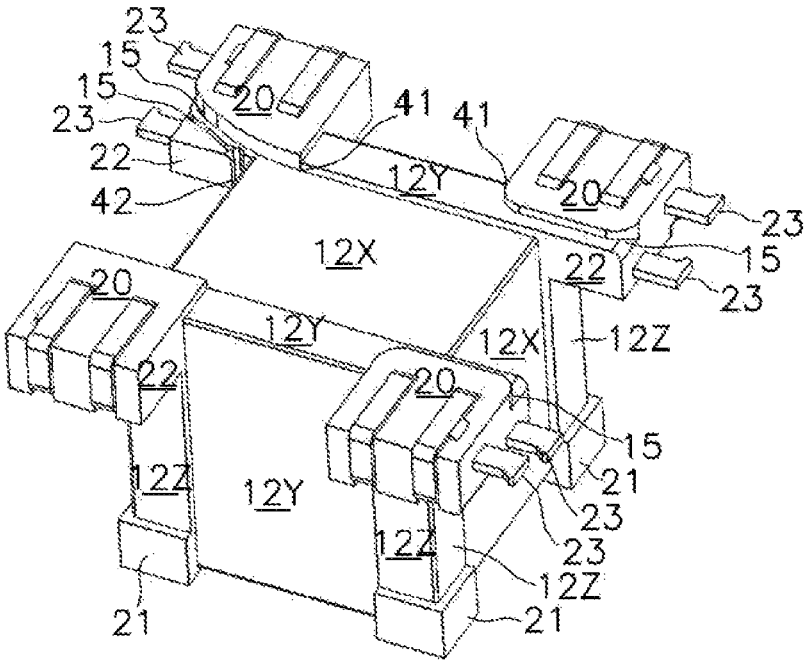
FIG. 3 shows the same electrically insulating support shown in FIG. 2 but seen from a lower part.
Figure 4:
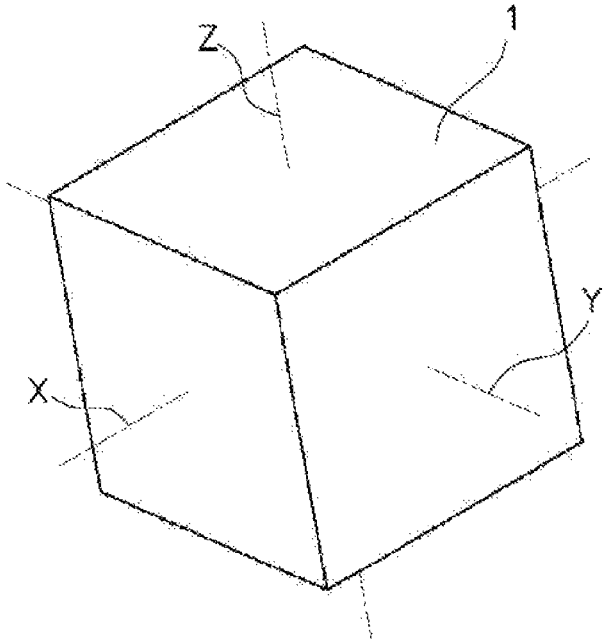
FIG. 4 shows a perspective view of the magnetic core.
Figure 5A:
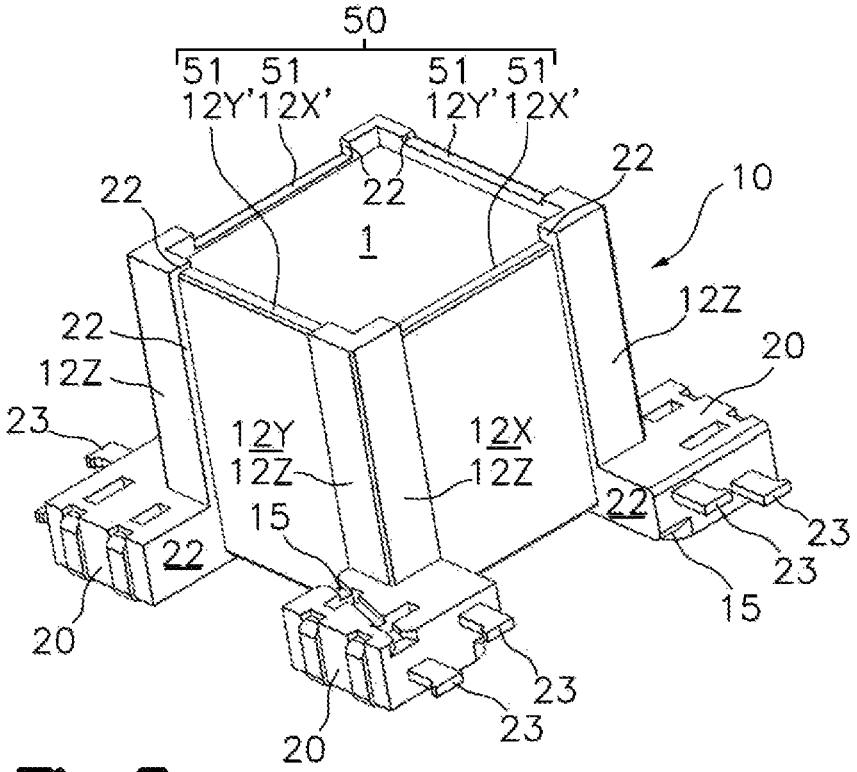
FIG. 5*a* shows a view of the same embodiment shown in FIG. 1 but with a magnetic core inserted into the cavity of the electrically insulating support.
Figure 5B:
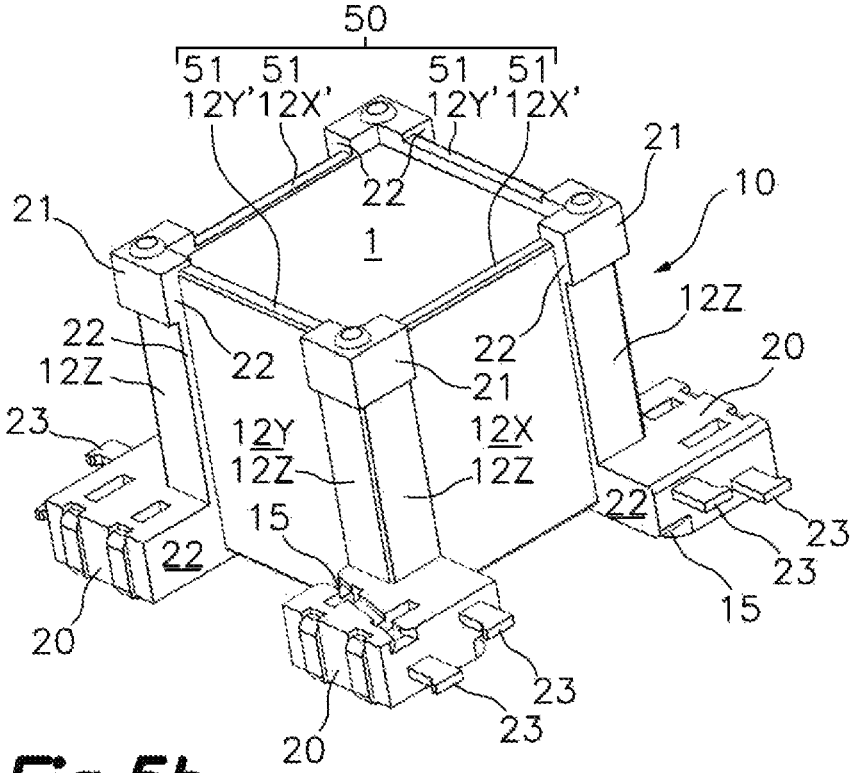
FIG. 5*b* shows a view of the same embodiment shown in FIG. 2 but with a magnetic core inserted into the cavity of the electrically insulating support.
Figure 6A:
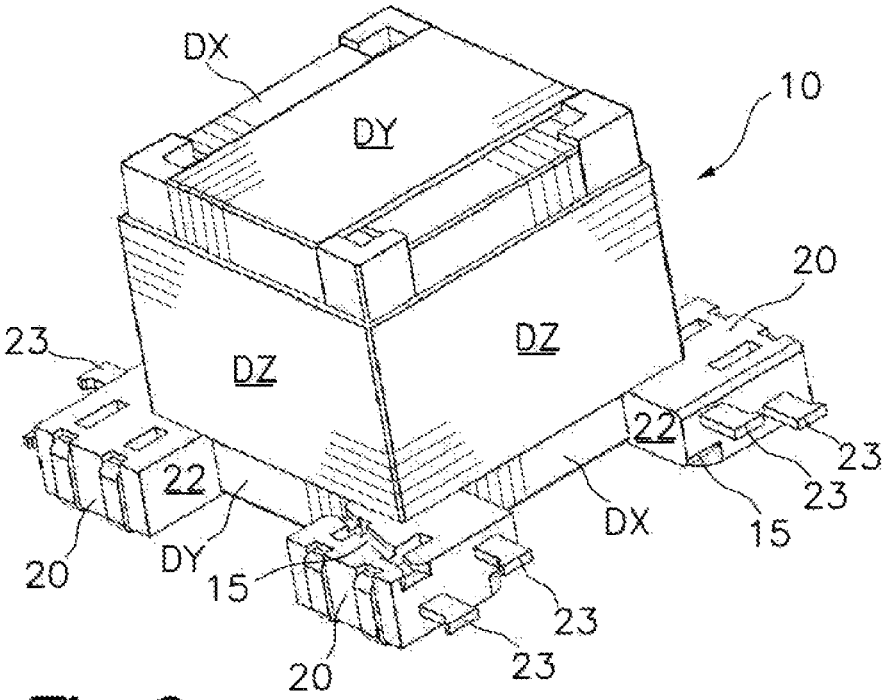
FIG. 6*a* shows a view of the same embodiment shown in FIG. 5*a* after winding up the three orthogonal windings.
Figure 6B:
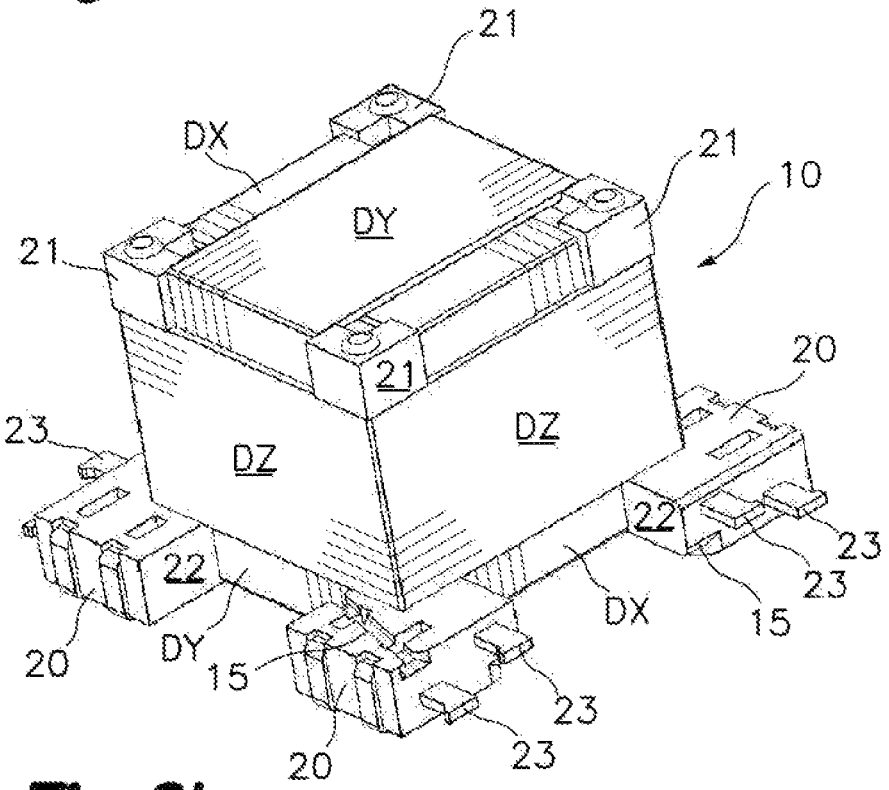
FIG. 6*b* shows a view of the same embodiment shown in FIG. 5*b* after winding up the three orthogonal windings.
Figure 7:
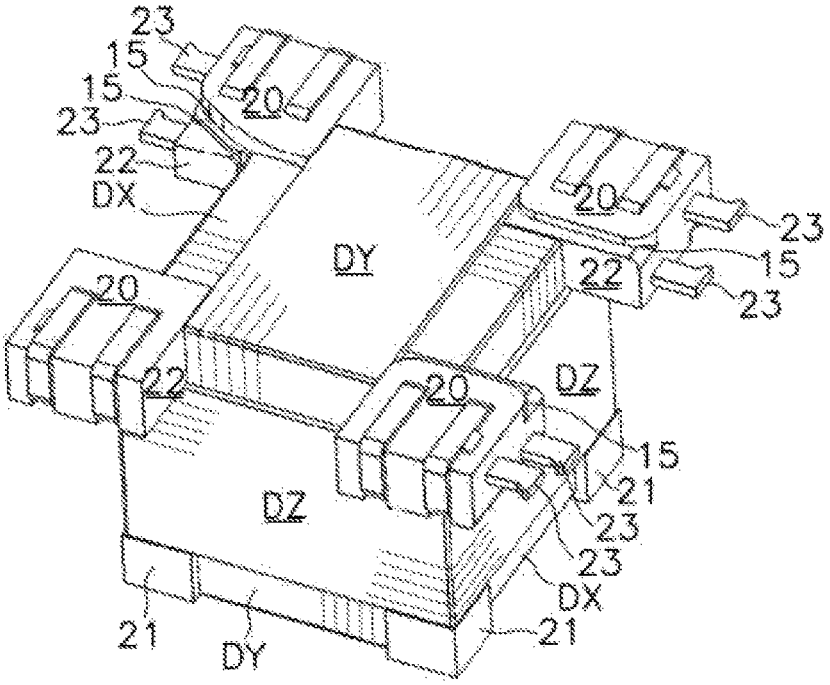
FIG. 7 shows the same wound up electrically insulating support shown in FIG. 6*b*, but seen from a lower part.
Figure 9:
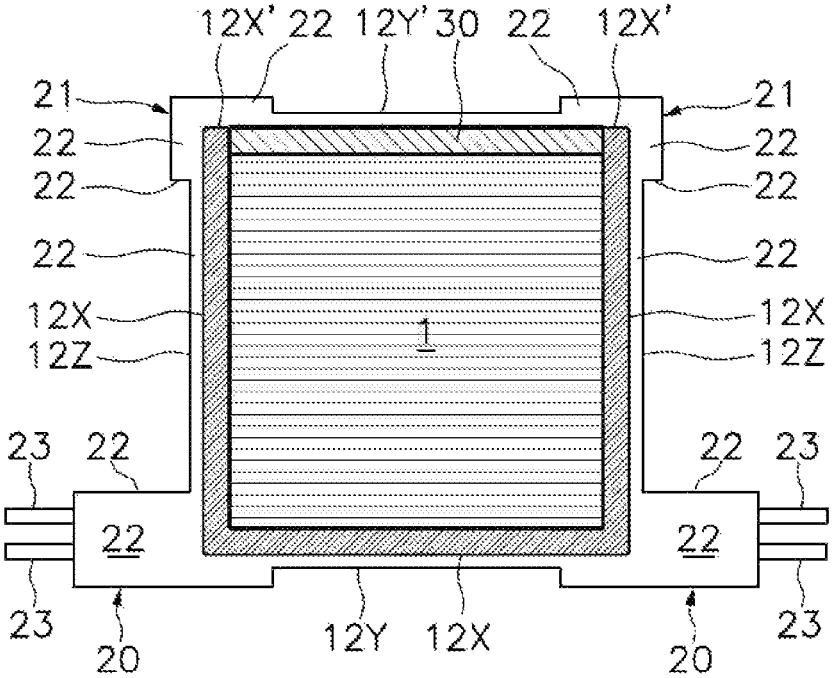
FIG. 9 shows a cross-section of the electrically insulating support containing a cubic magnetic core sealed by an epoxy resin layer, said section being obtained through a plane perpendicular to the axis X.
Figure 10:
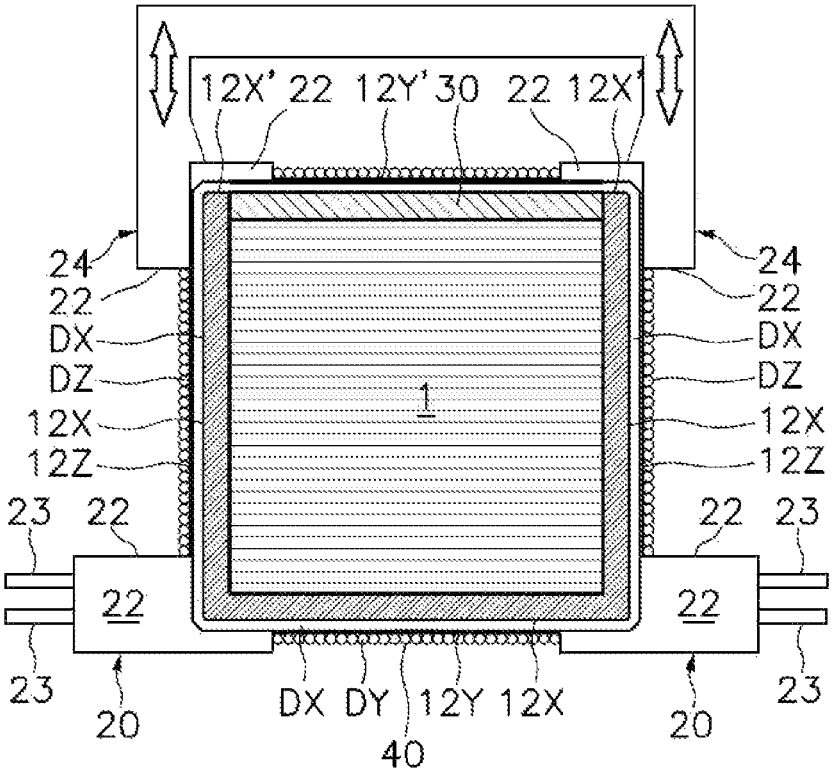
FIG. 10 shows an example of performing the method using an electrically insulating support devoid of upper corner protuberances.

Furthermore (see FIGS. 3, 9 and 10), the winding supporting outer faces 12X, 12Y and 12Z comprise supporting outer faces for supporting the winding DX (coaxial to the axis X) known as 12X, supporting outer faces for supporting the winding DY (coaxial to the axis Y) known as 12Y, and supporting outer faces for supporting the winding DZ (coaxial to the axis Z) known as 12Z, the faces corresponding to two different bisecting windings being arranged at a different level and linked in the stepped intersections, said step defining winding limiting edges 22.

The winding supporting outer faces 12X, 12Y and 12Z, together with the stepped intersections and with the winding limiting edges 22, form independent winding up channels at different level for each of the three windings DX, DY DZ.

The opening providing access to the inner cavity 11 of the electrically insulating support 10 is surrounded by a frame 50 having four sides 51 arranged opposite one another in pairs, said frame 50 being arranged flush with or above the level of the magnetic core 1 and said four sides 51 forming four additional winding supporting outer faces 12X and 12Y, having winding limiting edges 22 associated therewith, the three windings DX, DY and DZ being supported on said winding supporting faces 12X, 12Y and 12Z, confined between the winding limiting edges 22 and centered with respect to the three orthogonal axes X, Y, Z, such that said electrically insulating support 10 assures symmetry and orthogonality of said electromagnetic field vectors generated by the mentioned inductor device.

Since said electrically insulating support 10 is produced by a precision injection molding method, the regularity of all the inductors produced is assured. The geometry of said electrically insulating support 10 assures correct positioning of the three windings DX, DY and DZ arranged orthogonal to one another, in an automatic winding up process. This property allows significant savings in the processes of calibrating the individual inductors produced.

In the present embodiment, the winding DX around the axis X is the first to be made, and it is made on a continuous winding up channel surrounding three faces of the electrically insulating support 10 and also the opening of the inner cavity 11, said winding up channel being defined by continuous winding supporting outer faces 12X running the entire length of the outer faces of the electrically insulating support 10 with a width equivalent to the width existing between two opposite winding limiting edges 22 of the lower corner protuberances 20, said winding supporting faces 12X being connected at their ends and by the two winding supporting outer faces 12X of a lower level of the frame 50 of the opening of the cavity.

Winding up around the axis Y is the second to be done in this example, and it consists of a continuous winding up channel surrounding three faces of the electrically insulating support 10 and also the opening of the inner cavity, crossing the winding up around the axis X on the base of the support and also on the opening of the inner cavity 11, on opposite sides of the electrically insulating support 10.

Said winding up channel is defined by two continuous winding supporting outer faces 12Y running the entire length of two opposite outer faces of the electrically insulating support 10 with a width equivalent to the width existing between two opposite winding limiting edges 22 of the lower corner protuberances 20. This winding up channel is furthermore demarcated by two symmetrical winding supporting outer faces arranged on one and the same outer face of the base of the electrically insulating support, on opposite sides of the winding up channel for winding up around the axis X, and separated from same by means of a step, being at a higher level, and by the two winding supporting outer faces of a higher level of the frame 50 of the opening of the cavity 11, thereby determining that both windings X and Y cross one another at a different height both in the base and in the opening of the inner cavity 11.

Finally, winding up around the axis Z is the third to be done in this example, and it consists of a continuous winding up channel surrounding four outer faces of the electrically insulating support 10, crossing the windings DX and DY around the axes X and Y on each of said four outer faces.

Said winding up channel of the axis Z is defined by two symmetrical winding supporting outer faces 12Z arranged on each of the four outer faces of the electrically insulating support 10, on opposite sides of the winding up channel for winding up around the axes X or Y, and separated from same by means of a step, being arranged at a higher level, thereby determining that both windings DX and DY cross one another at a different height. In the electrically insulating support 10, said configuration determines winding supporting outer faces 12Z in the form of pilasters projecting from the four vertical corners of the electrically insulating support.

According to one embodiment, said four pilasters project from the frame defining the opening of the inner cavity, forming steps with respect to the respective four winding supporting outer faces 12X and 12Y defining said frame 50, determining winding limiting edges 22 of the windings DX and DY wound around axes X and Y crossing one another on said opening of the inner cavity 11.

According to another alternative embodiment, not claimed in this document but a feasible alternative embodiment of the invention, the electrically insulating support 10 further consists of four upper corner protuberances 21 arranged on four vertexes of the magnetic core 1, and likewise including winding limiting edges 22 perpendicular to the winding supporting outer faces 12X, 12Y and 12Z, the mentioned projecting pilasters in said embodiment being confined between the opposite winding limiting edges 22 of the upper corner protuberances 21 and lower corner protuberances 20.

The magnetic core 1 can be a block inserted in said cavity 11, but in a preferred embodiment it can be a magnetic cement poured in liquid or viscous state into the inner cavity of the electrically insulating support which will act as a container and mold during the setting of said magnetic cement until the hardening thereof. In an alternative embodiment, the mentioned core can be formed from a PBM or PBSM material which is provided by injection into the mentioned cavity (11).

Preferably, said hardened magnetic cement or said block does not occupy the entire inner cavity, an upper portion of the cavity being close to the opening that is not occupied. A polymer or epoxy resin is poured into said upper portion of the cavity that is not occupied, filling it, and being confined therein where it hardens, sealing the opening, retaining and insulating the magnetic core.

Some or all of the lower corner protuberances 20 are also proposed to include electrically conductive elements 23 to which the ends of the conductive wires 40 forming the respective three windings DX, DY and DZ are connected. Said electrically conductive elements 23 are metal strips partially embedded inside said lower corner protuberances 20, and are provided as electrical contacts which allow coupling said inductor device directly to a printed circuit (SMD mounting). In this example, three lower corner protuberances 20 each include two electrically conductive elements 23, each connected to an end of a conductive wire of one of the windings DX, DY and DZ.

Furthermore, each conductive wire 40 is guided from the electrically conductive element 23 to an entry point 41 or an exit point 42 (FIG. 3) of the corresponding winding thereof.

Figure 2:
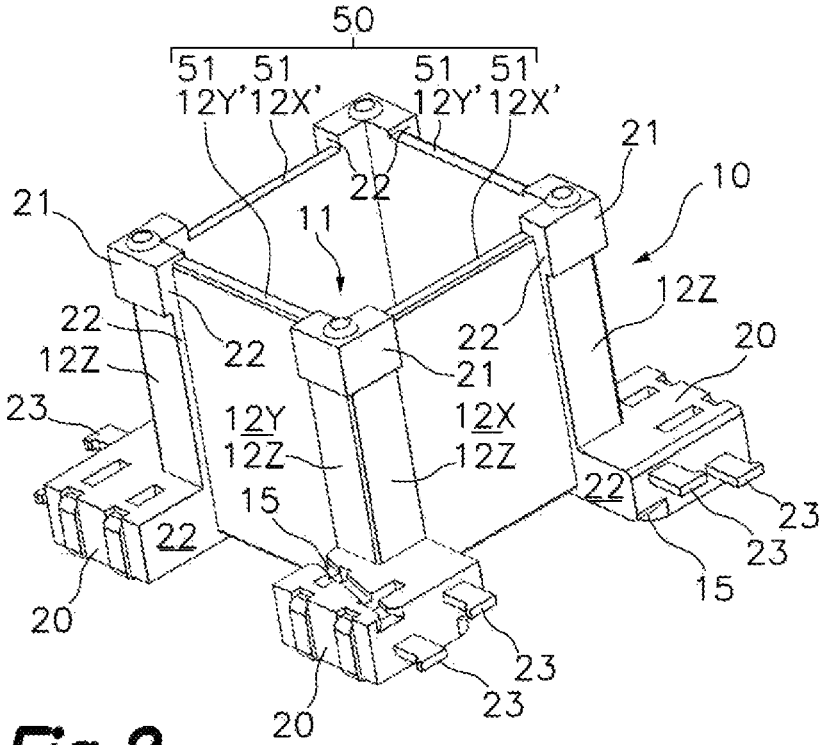
FIG. 2 shows a top perspective view of the electrically insulating support, without the magnetic core and windings, showing the inner cavity and the opening thereof, according to another embodiment provided with lower corner protuberances including electrically conductive elements and guiding configurations, and also provided, according to a feature not claimed in this document but a feasible alternative embodiment of the invention, with upper corner protuberances.

For such purpose, the mentioned electrically insulating support 10 includes guiding configurations 15 (FIGS. 1-3) for guiding the conductive wire 40 of each of the windings DX, DY, DZ, between the entry point 41 and the corresponding electrically conductive element 23 thereof and between the exit point 42 and the corresponding electrically conductive element 23 thereof, said guiding configurations 15 being formed by a notch, stepped recess or groove, such that a tensioned conductive wire 40 is precisely positioned in relation to the winding supporting outer face 12X, 12Y and 12Z and the winding up direction at said entry point.

In this example, a first lower corner protuberance 20 includes a guiding configuration 15 for guiding the conductive wire 40 of the winding DX around the axis X from the electrically conductive element 23 to the entry point 41 thereof located on a winding supporting outer face 12X, corresponding to a lower outer face of the support, in a position adjacent to the winding limiting edge 22. Said guiding configuration 15 consists of a curved step.

The remaining guiding configurations 15 will be the same but are adapted for their respective positions and their respective entry point 41 and exit point 42.

Figure 8:
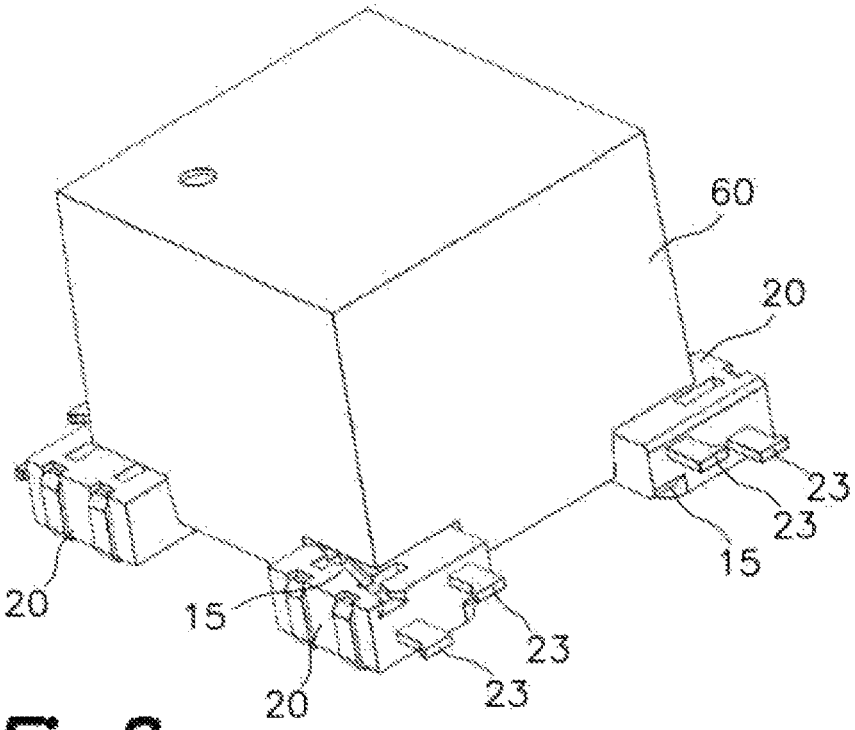
FIG. 8 shows an inductor device completed with a casing for covering the windings.

FIG. 8 shows a casing 60 for covering all three windings DX, DY and DZ for better protecting same, with only the lower corner protuberances 20 with their electrically conductive elements projecting therefrom.

It is understood that different parts forming the invention described in one embodiment may be freely combined with parts described in other different embodiments, even if said combination has not been explicitly described, provided that such combination is not a detriment.

What is claimed is:

1. An inductor device comprising:

a rectangular prismatic magnetic core with eight vertexes and three pairs of opposite faces facing and parallel to one another defining an axis X, an axis Y, and an axis Z orthogonal to one another each perpendicular to one of said pairs of opposite faces and passing through the geometric center of the opposite faces;

an electrically insulating support surrounding all but one of the opposite faces of the magnetic core and made of a single part with a rectangular prismatic cavity arranged around said magnetic core, said cavity completely housing the rectangular prismatic magnetic core and being accessible through an opening surrounded by a frame having four sides arranged opposite one another in pairs, said electrically insulating support being provided with:

two orthogonal winding up channels dimensioned to delimit respective two orthogonal windings (DX, DY) of conductive wire, said winding up channels being defined by winding supporting outer faces (12X, 12Y) each perpendicular to one of said axis X, Y, winding limiting edges perpendicular to the winding supporting outer faces (12X, 12Y), four additional winding supporting outer faces (12X' and 12Y') formed on said four sides of the frame and the winding limiting edges associated therewith;

winding supporting outer faces (12Z) perpendicular to one of said axis X and Y and configured to support a third winding (DZ) of conductive wire, orthogonal to the other two windings (DX, DY); and four lower corner protuberances arranged on four vertexes of the magnetic core, including winding limiting edges perpendicular to the winding supporting outer faces), said three windings being arranged orthogonal to one another wound around said magnetic core supported on said winding supporting faces (12X, 12Y, 12Z), confined between the winding limiting edges such that when a current circulates through the mentioned windings (DX, DY, DZ), an electromagnetic field with electromagnetic field vectors coaxial with the axes of each of the windings is generated, wherein:

said frame is arranged flush with or above the level of the magnetic core, said winding supporting outer faces (12Z) define four pilasters projecting from the four corners protuberances of the electrical insulating support, wherein an end of each pilaster also project from the frame forming steps determining said winding limiting edges;

said winding supporting outer faces extending from lower corner protuberances up to said pilaster end; and said winding supporting outer faces (12Z), where the third winding (DZ) is wound, provide surfaces delimited on one side by said limiting edges of the lower corner protuberances; and said third winding (DZ) is centered with respect to the orthogonal axes X and Y;

wherein said two orthogonal windings (DX, DY) and said third winding (DZ) are configured to in combination with the dimensions of the magnetic core define three isotropic orthogonal magnetic fields.

2. The device according to claim 1, wherein said third winding (DZ) around the axis Z is formed by a conductive wire provided with a self-adhesive coating.

3. The device according to claim 1, wherein said magnetic core is formed by:

a block which is tightly inserted in said part with a cavity forming the electrically insulating support, a magnetic cement set inside the cavity of said electrically insulating support, or a PBM or PB SM material injected into the mentioned cavity.

4. The device according to claim 3, wherein the mentioned magnetic core is coated with a polymer resin or epoxy resin layer occupying said open face of the electrically insulating support, and wherein the height of the magnetic core is smaller than the depth of the inner cavity of the electrically insulating support, and said epoxy resin layer has a thickness equal to the difference existing between said height of the magnetic core and depth of the inner cavity of the electrically insulating support.

5. The device according to claim 1, wherein the magnetic core is a cubic core and the dimensions of the three windings (DX, DY, DZ) are uniform, providing an inductor with isotropic properties.

6. The inductor device according to claim 1, wherein each of the three windings (DX, DY, DZ) of conductive wire has a conductive wire entry point and a conductive wire exit point that are different from one another and connected to the ends of electrically conductive elements integrated in each of said lower corner protuberances.

7. The inductor device according to claim 6, wherein the mentioned electrically insulating support includes conductive wire guiding configurations of each of the three windings (DX, DY, DZ) between the conductive wire entry point and the corresponding electrically conductive element thereof and between the conductive wire exit point and the corresponding electrically conductive element thereof, said guiding configurations being formed by a notch, stepped recess or groove, such that a tensioned conductive wire is precisely positioned in relation to the winding supporting outer faces (12X, 12Y and 12Z) and in the winding up direction at said conductive wire entry point or at said conductive wire exit point.

8. The device according to claim 1, wherein the winding supporting outer faces (12X, 12Y and 12Z) comprise winding supporting outer faces (12X) for supporting the winding (DX) wound around the axis X, winding supporting outer faces (12Y) for supporting the winding (DY) wound around the axis Y, and winding supporting outer faces (12Z) for supporting the winding (DZ) wound around the axis Y, the faces corresponding to two different bisecting windings arranged at a different level and linked in stepped intersections, said step defining winding limiting edges, and wherein two of said sides of the frame are at a lower level with respect to the other two sides.

9. A method of manufacturing an inductor device, comprising:

producing an electrically insulating support by injection molding, being made of a single hollow part open on one of the faces thereof with a rectangular prismatic cavity, provided for completely housing a magnetic core, and being accessible through an opening surrounded by a frame having four sides arranged opposite one another in pairs, said support being provided with:

two orthogonal winding up channels dimensioned to delimit respective two orthogonal windings (DX, DY), said winding up channels being defined by winding supporting outer faces (12X, 12Y and 12Z) each perpendicular to one axis X, Y or Z, winding limiting edges perpendicular to the winding supporting outer faces (12X, 12Y), four additional winding supporting outer faces (12X and 12Y) formed on said four sides of the frame and the winding limiting edges associated therewith;

winding supporting outer faces (12Z) perpendicular to one of said axis X and Y and configured to support a third winding (DZ) orthogonal to the other two windings (DX, DY); and four lower corner protuberances including winding limiting edges perpendicular to the winding supporting outer faces (12X, 12Y and 12Z), providing, inside said rectangular prismatic cavity of the electrically insulating support, a rectangular prismatic magnetic core with eight vertexes and three pairs of opposite faces facing and parallel to one another, defining said three axes X, Y and Z orthogonal to one another each perpendicular to one of said pairs of faces and passing through the geometric center of the faces;

providing three windings (DX, DY, DZ) of conductive wire arranged orthogonal to one another, wound around said magnetic core and supported on the winding supporting faces (12X, 12Y and 12Z), confined between the winding limiting edges;

wherein the method includes:

produce the electrically insulating support through a two-part mold lacking of upper corner protuberances in correspondence with the remaining four vertexes of the magnetic core, with said frame being arranged flush with or above the level of the magnetic core, and with the two orthogonal winding up channels being centered with respect to the orthogonal axes X, Y and Z, wound the third winding (DZ) on said winding supporting outer faces (12Z) delimited on one side by said limiting edges of the lower corner protuberances, centered with respect to the orthogonal axes X and Y, configured so that in combination with the dimensions of the magnetic core and with the other two orthogonal windings (DX, DY) define three isotropic orthogonal magnetic fields, wherein removable upper corner protuberances are furthermore provided before winding up the winding (DZ) around the axis Z and are removed when said winding up ends, such that the winding supporting faces (12Z) for supporting the winding (DZ) around the axis Z are demarcated between the electrically insulating support and said removable upper corner protuberances during the winding up step.

10. The method according to claim 9, wherein the winding (DZ) is a conductive wire wound around the axis Z and fixed therein with a self-adhesive coating of said conductive wire.

11. The method according to claim 9, wherein said magnetic core is formed by:

a block which is tightly inserted into said cavity of the electrically insulating support, a magnetic cement which is poured into, contained in and sets inside said cavity of the electrically insulating support, or a PBM or PB SM material injected into the mentioned cavity.

12. The method according to claim 9, wherein the electrically insulating support is produced including electrically conductive elements integrated in each of said lower corner protuberances; and wherein each winding (DX, DY, DZ) of conductive wire has a conductive wire entry point and a conductive wire exit point that are different from one another and connected to the ends of said electrically conductive elements;

and wherein the electrically insulating support is produced including guiding configurations for guiding the conductive wire of each of the windings (DX, DY, DZ) between the corresponding conductive wire entry point and the electrically conductive element thereof and between the corresponding conductive wire exit point and the electrically conductive element thereof, said guiding configurations being formed by a notch, stepped recess or groove.

13. The method according to claim 12, wherein the winding up process for winding up the three windings (DX, DY, DZ) is performed in three successive steps, each of which includes:

automatically positioning a tensioned conductive wire in its corresponding guiding configuration, a portion of said conductive wire being precisely positioned in relation to the winding supporting outer face (12X, 12Y and 12Z) at said conductive wire entry point and in the winding up direction;

automatically winding up said conductive wire around the magnetic core on the winding supporting outer faces (12X, 12Y and 12Z) from said conductive wire entry point to the corresponding conductive wire exit point, the winding being confined between the corresponding winding limiting edges;

automatically positioning a portion of said tensioned conductive wire from the conductive wire exit point in its corresponding guiding configuration, being precisely positioned in relation to said conductive wire exit point.

14. The method according to claim 12, wherein said automatic winding up process includes electrically connecting in an automatic manner each end of the conductive wire forming a winding (DX, DY, DZ) to a corresponding electrically conductive element of a lower corner protuberance, said conductive wire being arranged in tension between the mentioned electrical connection, the guiding configuration, and the conductive wire entry or exit point of the winding (DX, DY, DZ).

15. The device according to claim 2, wherein said magnetic core is formed by:

a block which is tightly inserted in said part with a cavity forming the electrically insulating support, a magnetic cement set inside the cavity of said electrically insulating support, or a PBM or PBSM material injected into the mentioned cavity.

16. A transmitting or receiving antenna including an inductor device comprising:

a rectangular prismatic magnetic core with eight vertexes and three pairs of opposite faces facing and parallel to one another defining an axis X, an axis Y, and an axis Z orthogonal to one another each perpendicular to one of said pairs of opposite faces and passing through the geometric center of the opposite faces, an electrically insulating support surrounding all but one of the opposite faces of the magnetic core and made of a single part with a rectangular prismatic cavity arranged around said magnetic core, said cavity completely housing the rectangular prismatic magnetic core and being accessible through an opening surrounded by a frame having four sides arranged opposite one another in pairs, said electrically insulating support being provided with:

two orthogonal winding up channels dimensioned to delimit respective two orthogonal windings of conductive wire, said winding up channels being defined by winding supporting outer faces each perpendicular to one of said axis X, Y, winding limiting edges perpendicular to the winding supporting outer faces, four additional winding supporting outer faces formed on said four sides of the frame and the winding limiting edges associated therewith;

winding supporting outer faces perpendicular to one of said axis X and Y and configured to support a third winding of conductive wire, orthogonal to the other two windings, and four lower corner protuberances arranged on four vertexes of the magnetic core, including winding limiting edges perpendicular to the winding supporting outer faces, said three windings being arranged orthogonal to one another wound around said magnetic core supported on said winding supporting faces, confined between the winding limiting edges such that when a current circulates through the mentioned windings, an electromagnetic field with electromagnetic field vectors coaxial with the axes of each of the windings is generated, wherein:

said frame is arranged flush with or above the level of the magnetic core, said winding supporting outer faces define four pilasters projecting from the four corners protuberances of the electrical insulating support, wherein an end of each pilaster also project from the frame forming steps determining said winding limiting edges, said winding supporting outer faces extending from lower corner protuberances up to said pilaster end; and said winding supporting outer faces, where the third winding is wound, provide surfaces delimited on one side by said limiting edges of the lower corner protuberances, and said third winding is centered with respect to the orthogonal axes X and Y, wherein said two orthogonal windings and said third winding are configured to, in combination with the dimensions of the magnetic core, define three isotropic orthogonal magnetic fields.

* * * * *